US006316878B1

(12) United States Patent
Tsukada

(10) Patent No.: US 6,316,878 B1
(45) Date of Patent: Nov. 13, 2001

(54) ELECTRIC-LIGHT BULB

(76) Inventor: Nagafumi Tsukada, 1311, Tamaki, Inasato-machi, Nagano-shi, Nagano 381-2214 (JP)

( * ) Notice: Subject to any disclaimer, the term of this patent is extended or adjusted under 35 U.S.C. 154(b) by 0 days.

(21) Appl. No.: 09/562,763

(22) Filed: May 2, 2000

(30) Foreign Application Priority Data

May 13, 1999 (JP) ..... 11-132548

(51) Int. Cl.[7] ..... H01J 13/46

(52) U.S. Cl. ..... 315/73; 315/71; 315/74; 315/106

(58) Field of Search ..... 315/50, 52, 71, 315/73, 74, 94, 104, 106, 179, 185 R

(56) References Cited

U.S. PATENT DOCUMENTS 3,858,086 * 12/1974 Anderson et al. ..... 315/49
3,868,540 * 2/1975 Passmore et al. ..... 315/73
4,001,634 * 1/1977 Corbley et al. ..... 315/73

FOREIGN PATENT DOCUMENTS 424257 2/1992 (JP) .
11086803 3/1999 (JP) .

* cited by examiner

*Primary Examiner*—Haissa Philogene
(74) *Attorney, Agent, or Firm*—Birch, Stewart, Kolasch & Birch, LLP

(57) ABSTRACT

The electric-light bulb is capable of limiting an inrush current and automatically periodically changing brightness. In the electric-light bulb, a filament is provided in a bulb body. A resistance is provided in the bulb body and connected to the filament in series. A thermoswitch is provided in the bulb body and connected to the resistance in parallel. The thermoswitch includes a bimetal element and contact points. The bimetal element is deformed by heat radiated from the filament and closes the contact points when temperature of the bimetal element reaches prescribed temperature so as to short the resistance.

2 Claims, 5 Drawing Sheets

ELECTRIC-LIGHT BULB

BACKGROUND OF THE INVENTION

The present invention relates to an electric-light bulb, more precisely relates to an electric-light bulb, which is capable of automatically adjusting an electric current passing through a filament.

A conventional electric-light bulb is shown in FIGS. 7A and 7B. A base 52 is provided to a glass bulb body 54. A pair of lead lines 56*a* and 56*b* are provided in the bulb body 54 and vertically extended from a pitch 58 with a separation. A filament 60 is spanned between upper ends of the lead lines 56*a* and 56*b*. The base 52 acts as terminals for supplying an electric current to the lead lines 56*a* and 56*b*.

When the electric current is supplied to the lead lines 56*a* and 56*b* via the base 52, the filament 60 is red-heated by the electric current supplied and radiates light, so that the electric-light bulb 50 is turned on.

In the room temperature, resistance of the filament 60 is low, so an inrush current, which is 13–16 times as great as a rated current, instantaneously passes through the filament 60 when the electric-light bulb 50 is turned on. By turning on and off the electric-light bulb 50, a great load is applied to the filament 60, so that a span of life of the electric-light bulb 50 must be shorter.

In the case of an electric-light bulb which is used at a place where the electric-light bulb cannot be easily exchanged, etc. and which must have a long span of life, a resistance (not shown) is provided in a bulb body and connected to a filament in series so as to limit intensity of electric current passing through the filament. Further, a thermistor, whose resistance is reduced when temperature of the filament rises, is provided so as to limit the inrush current passing through the filament.

The conventional electric-light bulbs, which include various types of bulbs in which filaments radiate light, are used for decorating show windows, Christmas trees, etc. and calling people's attention at construction sites, etc. Further, in some cases, a plurality of electric-light bulbs are connected and automatically turned on and off.

To automatically turned on and off the electric-light bulb, a bimetal element is provided in a bulb body and connected to a filament in series. The bimetal elements turns on and off the electric-light bulb as a thermoswitch.

In an initial state, temperature in the bulb body is low, so contact points of the thermoswitch are closed by the bimetal element. An electric current can be supplied to the filament.

When the filament radiates heat and temperature of the bimetal element reaches prescribed temperature, the contact points are opened, so that the electric current passing through the filament is stopped.

By stopping the current supply, the temperature in the bulb body gradually goes down, then the contact points are closed again and the electric current can be supplied to the filament again.

By repeating above described actions, the electric-light bulb can be automatically turned on and off.

However, the conventional electric-light bulb has following disadvantages.

Firstly, in the case of the electric-light bulb having the thermistor for limiting the inrush current, manufacturing cost must be increased because the thermistor is expensive.

Secondly, in the case of using the electric-light bulbs for decorating windows, etc. and calling attention, the conventional electric-light bulbs can be merely turned on and off. These days, electric-light bulbs, which is capable of changing brightness, are required so as to more effectively decorating or calling attention. But the conventional electric-light bulbs cannot automatically change their brightness.

SUMMARY OF THE INVENTION

An object of the present invention is to provide an electric-light bulb capable of automatically control an electric current passing through a filament so as to limit an inrush current.

Another object of the present invention is to provide an electric-light bulb capable of automatically periodically changing brightness.

To achieve the objects, the present invention has following basic structures.

A first basic structure of the electric-light bulb of the present invention comprises:

a bulb body;

a filament being provided in the bulb body;

a resistance being provided in the bulb body, the resistance being connected to the filament in series; and a thermoswitch being provided in the bulb body, the thermoswitch being connected to the resistance in parallel, the thermoswitch including a bimetal element and contact points, wherein the bimetal element is deformed by heat radiated from the filament and closes the contact points when temperature of the bimetal element reaches prescribed temperature so as to short the resistance.

With this structure, the temperature of the bimetal element is low and the contact points of the thermoswitch are closed when the electric-light bulb is turned on. Namely, the resistance, which is connected to the filament in series, is not shorted, so an inrush current can be limited. By limiting the inrush current, a span of life of the electric-light bulb can be extended. Since the resistance is not shorted, a brightness of the electric-light bulb is low. When the temperature in the bulb body reaches the prescribed temperature, the resistance is shorted by the bimetal element, so that the brightness of the electric-light bulb is made higher. After the brightness is made higher, the high Brightness State can be continued as far as the electric current is supplied. The bimetal element is inexpensive, so manufacturing cost of the electric-light bulb can be reduced.

A second basic structure of the electric-light bulb of the present invention comprises:

a bulb body;

a filament being provided in the bulb body;

a resistance being provided in the bulb body, the resistance being, connected to the filament in series; and a thermoswitch being provided in the bulb body, the thermoswitch being, connected to the resistance in parallel, the thermoswitch including a bimetal element and contact points, wherein the bimetal element is deformed by heat radiated from the filament and opens the contact points when temperature of the bimetal element reaches prescribed temperature so as to reduce an electric current passing through the filament by the resistance, and wherein the bimetal element returns to an initial state and recloses the contact points after the contact points are opened and the heat radiated from the filament is reduced.

With this structure, the contact points of the thermoswitch are closed until the temperature in the bulb body reaches the prescribed temperature, so that the resistance is shorted and the electric current is supplied to the filament. Thus, the brightness of the electric-light bulb is made high. When the temperature of the bimetal element reaches the prescribed temperature, the bimetal element deforms and opens the contact points. By opening the contact points, the electric current passing through the filament is limited by the resistance, so that the brightness of the electric-light bulb is made lower. By limiting the current passing through the filament, the temperature in the bulb body goes down. When the temperature reaches to the prescribed temperature, the bimetal element returns to an initial state, so that the contact points are closed again and the brightness of the electric-light bulb is made high again.

The current passing through the filament can be automatically periodically changed, so that the electric-light bulb can alternately change the brightness. With this action, the electric-light bulb can effectively decorate windows, etc. and effectively call attention. Since the current intensity is always changed, the filament is not overloaded and a durability of the electric-light bulb can be improved.

A third basic structure of the electric-light bulb of the present invention comprises:

a bulb body;

a filament being provided in the bulb body;

a resistance being provided in the bulb body, the resistance being connected to the filament in series;

a first thermoswitch being provided in the bulb body, the first thermoswitch being connected to the resistance in parallel, the first thermoswitch including a first bimetal element and first contact points; and a second thermoswitch being provided in the bulb body, the second thermoswitch being connected to the resistance in series, the second thermoswitch including a second bimetal element and second contact points, wherein the first bimetal element and the second bimetal element are deformed by heat radiated from the filament, so that the first contact points are firstly opened so as to reduce an electric current passing through the filament by the resistance, then the second contact points are opened so as to stop the electric current passing through the filament, and wherein the first bimetal element and the second bimetal element return to initial states, so that the first contact points are firstly reclosed, then the second contact points are reclosed.

The first and the second contact points are closed until the temperature of the first and the second bimetal elements reach the prescribed temperatures. In this state, the resistance is shorted and the electric current is supplied to the filament, so that the brightness of the electric-light bulb is made high. By the heat radiated from the filament, the first and the second bimetal elements deform. But the first bimetal element firstly opens the first contact points so as to stop shorting the resistance. In this state, the electric current passing through the filament is limited by the resistance, so that the brightness of the electric-light bulb is made lower. By properly setting a resistance value of the resistance, the temperature in the bulb body can gradually rise in spite of reducing calorific power of the filament with the current reduction. When the temperature of the bulb body further rises, the second contact points are opened later so as to stop supplying the electric current to the filament. By stopping the current supply, the electric-light bulb is turned off. Then, the temperature of the bulb body goes down and the first and the second bimetal elements return to the initial states, so that the first contact points are firstly reclosed, then the second contact points are reclosed. By closing the first and the second contact points, the electric current can be supplied to the filament again.

While the electric current is supplied, the current passing through the filament can be automatically periodically changed and turned off. Therefore, the electric-light bulb can repeatedly change states of; light; dark; and off. Namely, the electric-light bulb is capable of repeating the three states in that order, so that the electric-light bulb can effectively decorate windows, etc. and effectively call attention.

A fourth basic structure of the electric-light bulb of the present invention comprises:

a bulb body;

a filament being provided in the bulb body;

a resistance being provided in the bulb body, the resistance being connected to the filament in series;

a first thermoswitch being provided in the bulb body, the first thermoswitch being connected to the resistance in parallel, the first thermoswitch including a first bimetal element and first contact points; and a second thermoswitch being provided in the bulb body, the second thermoswitch being connected to the resistance in series, the second thermoswitch including a second bimetal element and second contact points, wherein the first bimetal element and the second bimetal element are deformed by heat radiated from the filament, so that the first contact points are firstly closed so as to short the resistance and increase an electric current passing through the filament, then the second contact points are opened so as to stop the electric current passing through the filament, and wherein the first bimetal element and the second bimetal element return to initial states, so that the first contact points are firstly reopened, then the second contact points are reclosed.

The first contact points are opened and the second contact points are closed until the temperature of the first and the second bimetal elements reach the prescribed temperatures. In this state, the electric current is supplied to the filament via the resistance, so that the brightness of the electric-light bulb is made low. By the heat radiated from the filament, the first and the second bimetal elements deform. But the first bimetal element firstly closes the first contact points so as to short the resistance. In this state, the electric current passing through the filament is not limited by the resistance, so that the brightness of the electric-light bulb is made higher. When the temperature of the bulb body further rises, the second contact points are opened later so as to stop supplying the electric current to the filament. By stopping the current supply, the electric-light bulb is turned off. Then, the temperature of the bulb body goes down and the first and the second bimetal elements return to the initial states, so that the first contact points are firstly reopened, then the second contact points are reclosed. By returning the first and the second contact points to the initial states, the second contact points are reclosed, so that the electric current can be supplied to the filament again.

While the electric current is supplied, the current passing through the filament can be automatically periodically changed and turned off. Therefore, the electric-light bulb can repeatedly change states of: dark; light; and off. Namely, the electric-light bulb is capable of repeating the three states in that order, so that the electric-light bulb can effectively decorate windows, etc. and effectively call attention.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

First Embodiment

An electric current passing through a filament of an electric-light bulb is controlled immediately after turning on the electric-light bulb so as to limit an inrush current passing through the filament.

Figure 7A:
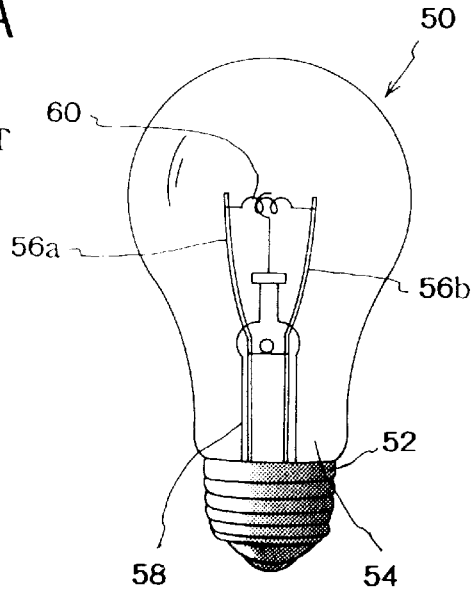
FIG.7A PRIOR ART
FIG. 7A is a front view of the conventional electric-light bulb.
Figure 7B:
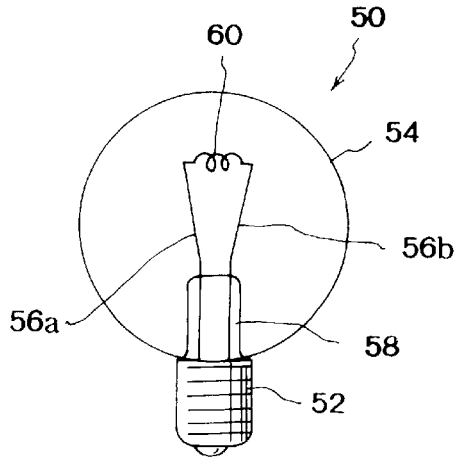
FIG.7B PRIOR ART
FIG. 7B is an explanation view of the conventional electric-light bulb.

A structure of the electric-light bulb 10 will be explained with reference to FIG. 1. Elements, which constitute the conventional electric-light bulb 50 (see FIGS. 7A and 7B), are assigned the same numeric symbols and detail explanation will be omitted.

Figure 1:
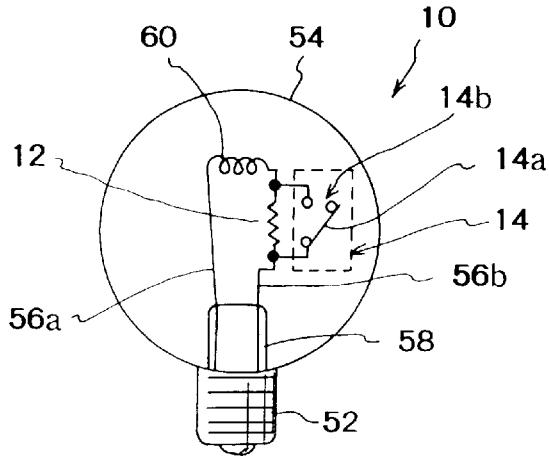
FIG. 1 is an explanation view of an electric-light bulb of a first embodiment of the present invention.

In FIG. 1, the base 52 is attached to the glass bulb body 54. A pair of the lead lines 56*a* and 56*b* are vertically extended from the pitch 58. The filament 60 is spanned between upper ends of the lead lines 56*a* and 56*b*.

The electric-light bulb 10 is characterized by: a resistance 12, which is connected to the filament 60 in series; and a thermoswitch 14, which includes a thermoswitich connected to the resistance 12 in parallel. In the thermoswitch 14, a bimetal element 14*a* opens and closes contact points 14*b*. The resistance 12 and the thermoswitch 14 are provided in the bulb body 54. At the room temperature, the bimetal element 14*a* opens the contact points 14*b*. When temperature in the bulb body 54 raised, by heat radiated from the filament 60, to a prescribed temperature, the bimetal element 14*a* deforms and closes the contact points 14*b*.

Successively, action of the electric-light bulb 10 will be explained.

Before the electric-light bulb 10 is turned on, no electric current is supplied and the temperature in the bulb body is the room temperature. Therefore, temperature of the bimetal element 14 is also the room temperature, so the contact points 14*b* of the thermoswitch are opened. In this state, the resistance 12 is not shorted by the thermoswitch 14.

When the electric-light bulb 10 is turned on, the electric current is supplied to the filament 60 via the resistance 12. In the conventional electric-light bulb 50, the inrush current passes the filament 60 until the temperature of the filament 60 raised to a prescribed temperature and a resistance value of the filament 60 is increased to a prescribed value. But, in the present embodiment, the inrush current is limited by the resistance 12, so that deterioration of the filament 60 can be prevented and durability of the electric-light bulb 10 can be improved. Note that, in this state, the resistance 12 limits the electric current passing through the filament 60, so the electric-light bulb 10 emits light with lower brightness.

The electric-light bulb 10 emits light, with the lower brightness, for a while, then heat radiated from the filament 60 rises the temperature of the bulb body 54 and the bimetal element 14*a*, so that the bimetal element 14*a* deforms or curves itself. When the temperature of the bimetal element 14*a* reaches a prescribed temperature, the contact points 14*b* are closed by the bimetal element 14*a*. With this action, the resistance 12 is shorted by the thermoswitch 14, and the electric current passing through the filament 60 is not limited by the resistance 12. Since the filament 60 has been heated, the resistance value of the heated filament 60 is great enough in comparison with that at the room temperature. Therefore, the inrush current can be properly limited despite the resistance 12 is shorted. By limiting the inrush current, the deterioration of the filament 60 can be prevented, and the span of life of the electric-light bulb 10 can made longer. Note that, in the state of shorting the resistance 12, the electric-light bulb 10 emits light with higher brightness as well as the conventional electric-light bulb.

Once the electric-light bulb 10 emits light with the high brightness, the temperature of the bulb body 54 is heated, so the electric-light bulb 10 continuously emits light as far as the electric current is supplied.

Second Embodiment

The electric-light bulb of the second embodiment is capable of repeatedly changing the brightness by controlling the electric current passing through the filament. It can be effectively used for decorating and calling attention.

Figure 2:
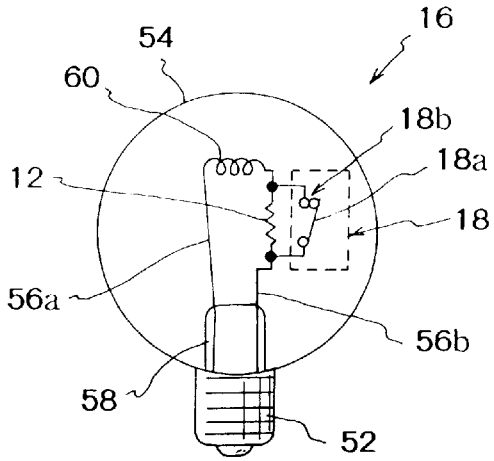
FIG. 2 is an explanation view of an electric-light bulb of a second embodiment of the present invention.

The second embodiment will be explained with reference to FIG. 2. The basic structure of the electric-light bulb 16 of the second embodiment is the same as that of the first embodiment, so structural elements explained in the first embodiment are assigned the same numeric symbols and explanation will be omitted.

In the first embodiment, the contact points 14*b* of the thermoswitch 14 are closed at the room temperature, and they will be opened by the heat from the filament 60. On the other hand, in the present embodiment, a thermoswitch 18 of the electric-light bulb 16 acts the other way. Namely, contact points 18*b* of the thermoswitch 18 is closed at the room temperature. When the temperature of the filament 60 rises to a prescribed temperature, a bimetal element 18*a* deforms, by the heat from the filament 60, and closes the contact points 18*b*.

When the contact points 18*b* are opened and the electric current passing through the filament 60 is limited by the resistance 12, the filament 60 is capable of continuously radiating heat but calorific power of the filament 60 steeply goes down, so that the temperature of the bimetal element 18*a* also goes down. Since the temperature of the bimetal element 18*a* goes down, the bimetal element 18*a* returns to the initial state and closes the contact points 18*b*. Thermocharacteristics of the bimetal element 18*a* and a resistance value of the resistance 12 are selected so as to execute above described function.

Successively, the action of the electric-light bulb 16 will be explained.

At the beginning, no electric current is supplied to the electric-light bulb 16, so the temperature of the bulb body 54 and the bimetal element 18*a*, which is accommodated in the bulb body 54, are the room temperature. Therefore, the bimetal elements 18*a* closes the contact points 18*b* of the thermoswitch 18, and the resistance 12 is shorted by the thermoswitch 18.

By supplying the electric current to the electric-light bulb 16, the electric current passes through the filament 60, so that the electric-light bulb 16 emits light with high brightness as well as the conventional electric-light bulb.

After a while, the temperature of the bulb body 54 and the bimetal elements 18*a* are raised, so that the bimetal element 18*a* deforms or curves itself. Upon reaching the prescribed temperature, the deformed bimetal element 18*a* closes the contact points 18*b*. By closing the contact points 18*b*, the electric current passing through the filament 60 is limited by the resistance 12, so that the calorific power of the filament 60 goes down. Thus, the electric-light bulb 16 emits light with lower brightness.

Since the calorific power of the filament 60 steeply goes down, the temperature of the bulb body 54 and the bimetal element 18*a* go down. Since the temperature of the bimetal element 18*a* goes down, the bimetal element 18*a* returns to the initial state and closes the contact points 18*b* again. By closing the contact points 18*b*, the resistance 12 is shorted by the thermoswitch 18, so that the electric-light bulb 16 emits light with high brightness again and the temperature of the bulb body 54 is raised again.

While the electric current is supplied to the electric-light bulb 16, the above described steps are repeated. Namely, current intensity of the electric current passing through the filament 60 is automatically periodically changed, so that the brightness of the electric-light bulb 16 can be repeatedly changed.

Third Embodiment

The electric-light bulb of the third embodiment is capable of repeatedly changing three states: a light state; a dark state; and a turn-off state.

The third embodiment will be explained with reference to FIG. 3. The basic structure of the electric-light bulb 20 of the third embodiment is the same as that of the first and the second embodiments, so structural elements explained in the first and the second embodiments are assigned the same numeric symbols and explanation will be omitted.

Figure 3:
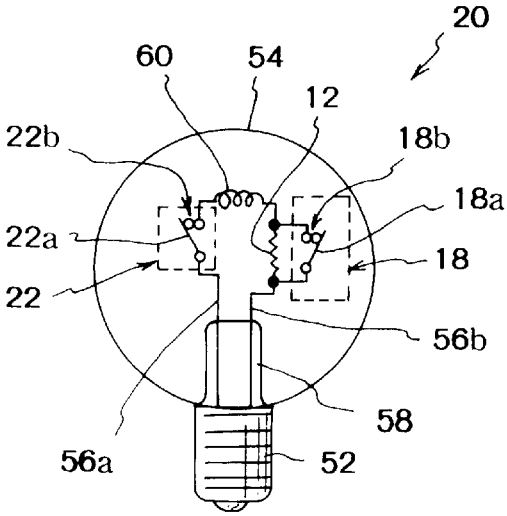
FIG. 3 is an explanation view of an electric-light bulb of a third embodiment of the present invention.

In the third embodiment, as shown in FIG. 3, the electric-light bulb 20 includes the structural elements of the second embodiment and further includes another thermoswitch 22, which is connected to the resistance 12 in series and whose contact points are opened and closed by a bimetal element.

There arc two thermoswitches 18 and 22 in the bulb body 54. So, the thermoswitch 18, which is connected to the resistance in parallel, is called the first thermoswitch; the thermoswitch 22, which is connected to the resistance 12 in series, is called the second thermoswitch. The bimetal clement 18*a* of the first thermoswitch 18 opens and closes the contact points 18*b*; the bimetal element 22*a* of the second thermoswitch 22 opens and closes the contact points 22*b*.

Thermocharacteristics of the thermoswitches 18 and 22 are mutually different. The first thermoswitch 18 is more thermosensitive than the second thermoswitch 22. When the temperature of the bulb body 54 is raised by the heat from the filament 60, the first thermoswitch 18 firstly acts to open the contact points, then the second thermoswitch 22 acts late. On the other hand, when the temperature of the bulb body 54 goes down too, the first thermoswitch 18 firstly acts to close the contact points, then the second thermoswitch 22 acts late. To have different thermocharacteristics, thickness of the first and the second bimetal elements 18*a* and 22*a* are mutually different, so that specific heat of the first bimetal element 18*a* is less than that of the second bimetal element 22*a*. Therefore, the first bimetal element 18*a* is more thermosensitive than the second bimetal element 22*a*. Further, cut-off temperature of the first bimetal element 18*a* is lower than that of the second bimetal element 22*a*.

The bimetal elements 18*a* and 22*a* are designed to execute above described functions.

Figure 4:
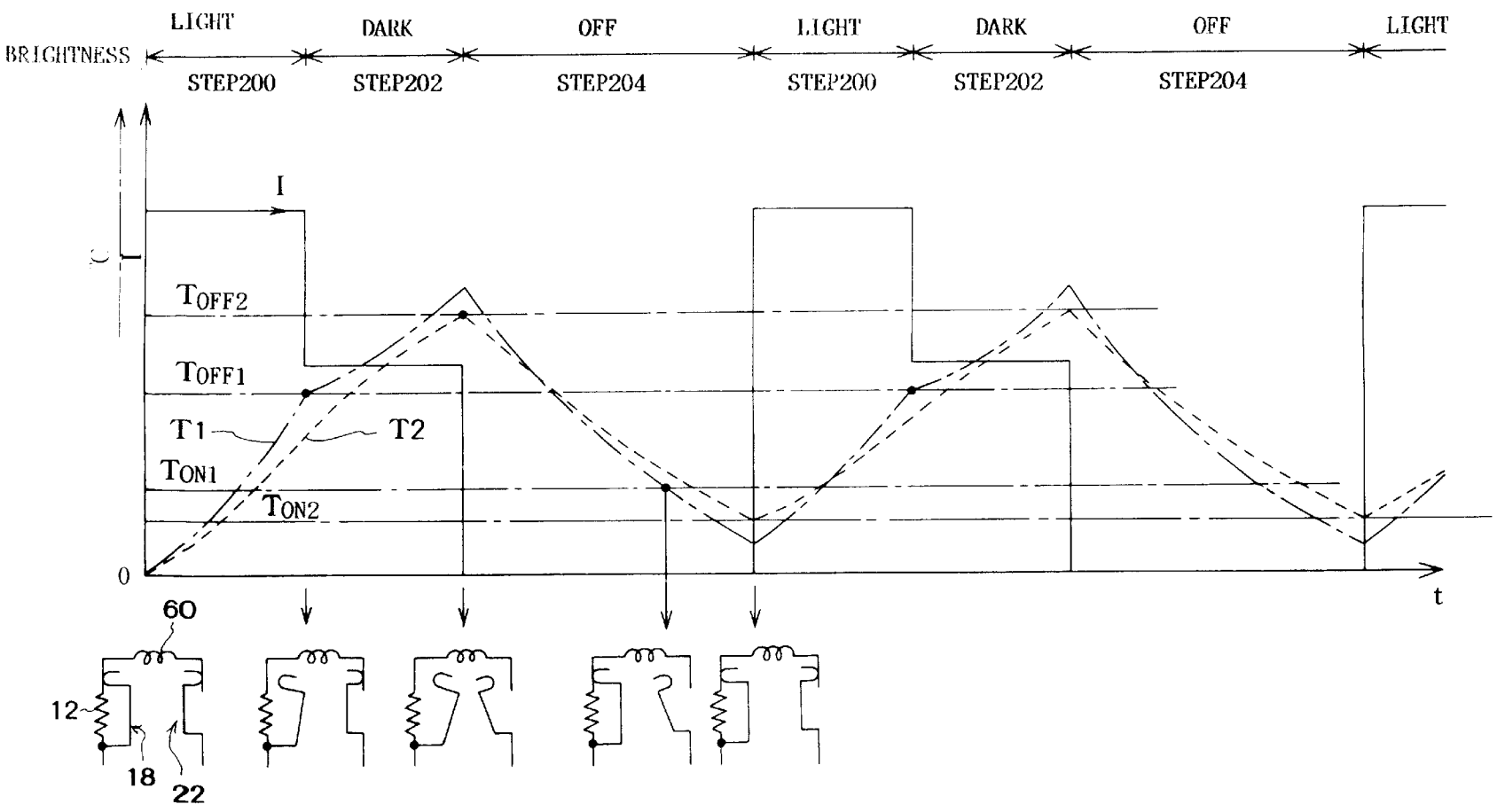
FIG. 4 is a graph showing a relationship between the temperature of a bimetal element and an electric current passing through a filament in the electric-light bulb shown in FIG. 3.

Successively, the action of the electric-light bulb 20 of the present embodiment will be explained with reference to FIGS. 3 and 4.

At the beginning, no electric current is supplied to the electric-light bulb 20, so the temperature of the bulb body 54 is the room temperature. And, temperature T1 of the first bimetal element 18*a* and temperature T2 of the second bimetal element 22*a* are the room temperature. Therefore, the first bimetal element 18*a* closes the first contact points 18*b* of the first thermoswitch 18, so that the resistance 12 is shorted by the first thermoswitch 18. The second bimetal element 22*a* also closes the second contact points 22*b* of the second thermoswitch 22, so that the electric current can be supplied to the filament 60.

When the electric current is supplied to the electric-light bulb 20, the resistance 12 is shorted by the first thermoswitch 18 and the electric current passes through the filament 60, so that the electric-light bulb 20 emits light with high brightness (STEP 200). This is the light state.

After a while, the temperature of the bulb body 54 and the bimetal elements 18*a* and 22*a* are raised. As described above, the first thermoswitch 18, whose bimetal element 18*a* has higher thermosensitivity, firstly reaches Off-temperature $T_{OFF1}$, so that the first contact points 18*b* are opened. Then, shorting the resistance 12 is stopped, and the electric current passing through the filament 60 is limited, so that the electric-light bulb 20 emits light with lower brightness (STEP 202). This is the dark state.

Unlike the electric-light bulb 16 of the second embodiment, the resistance value of the resistance 12 is selected so as to gradually rise the temperature in the bulb body 54 while the resistance 12 limits the electric current passing through the filament 60 and the electric-light bulb 20 emits light with lower brightness.

The second thermoswitch 22 reaches Off-temperature $T_{OFF2}$ after the first contact points 18*b* of the first thermoswitch 18 are opened, so that the second contact points 22*b* of the second thermoswitch 22 are opened. Then, the electric current is not supplied to the filament 60, and the electric-light bulb 20 is turned off (STEP 204). This is the turn-off state.

After the electric-light bulb 20 is turned off, the temperature of the bulb body 54 and the bimetal elements 18*a* and 22*a* go down. Since the temperature of the bimetal elements 18*a* and 22*a* goes down, the bimetal elements 18*a* and 22*a* return to the initial states. But the temperature of the first bimetal element 18*a* reaches On-temperature $T_{ON1}$ and the first bimetal element 18*a* firstly returns to the initial state, so that the first contact points 18*b* are reclosed. In this state, the second contact points 22*b* are still opened, so no electric current is supplied to the filament 60 and the electric-light bulb 20 is still turned-off.

The temperature of the bulb body 54 and the second bimetal element 22*a* go down for a while. When the temperature of the second bimetal element 22*a* reaches On-temperature $T_{ON2}$ and the second bimetal element 22*a* returns to the initial state, so that the second contact points 22*b* are reclosed. Namely, the state returns to the state of STEP 200. In this state, the electric current is supplied to the filament 60 and the electric-light bulb 20 emits light with the high brightness.

As far as the electric current is supplied to the electric-light bulb 20 from outside, the STEPS 200–204 are repeated, so that intensity of the electric current passing through the filament can be periodically changed. Namely, the electric-light bulb 20 can periodically repeat the dark state, the light state, and the turn-off state in order.

Fourth Embodiment

The electric-light bulb of the fourth embodiment is capable of repeatedly changing three states: a light state; a dark state; and a turn-off state.

Figure 5:
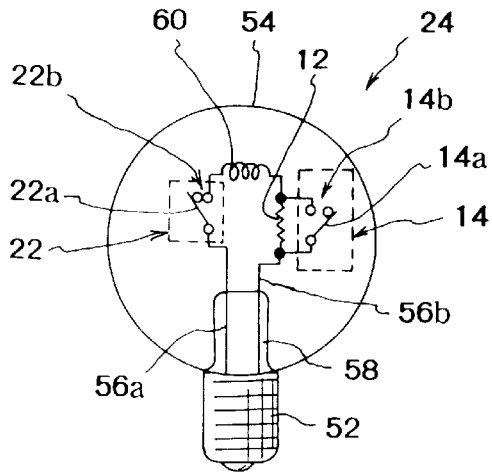
FIG. 5 is an explanation view of an electric-light bulb of a fourth embodiment of the present invention.

The fourth embodiment will be explained with reference to FIG. 5. The basic structure of the electric-light bulb 24 of the fourth embodiment is similar to that of the third embodiment, so structural elements explained in the third embodiment are assigned the same numeric symbols and explanation will be omitted.

In the third embodiment, the first contact points 18*a* of the first thermoswitch 18 are closed at the room temperature, and they are opened when the temperature of the first bimetal element 18*a* rises and reaches the prescribed temperature. On the other hand, in the fourth embodiment, as shown in FIG. 5, the electric-light bulb 24 includes the first thermoswitch 14, which is the same as the thermoswitch 14 of the first embodiment and whose first contact points 14*b* are opened at the room temperature. When the temperature of the first contact points 14*b* are closed when the temperature of the first bimetal element 18*a* rises and reaches a prescribed temperature.

There are the first thermoswitch 14 and the second thermoswitch 22 are provided in the bulb body 54. Note that, the first thermoswitch 14 is more thermosensitive than the second thermoswitch 22. When the temperature of the bulb body 54 is raised by the heat from the filament 60, the first thermoswitch 14 firstly acts to close the contact points, then the second thermoswitch 22 acts late. On the other hand, when the temperature of the bulb body 54 goes down too, the first thermoswitch 14 firstly acts to open the contact points, then the second thermoswitch 22 acts late.

Figure 6:
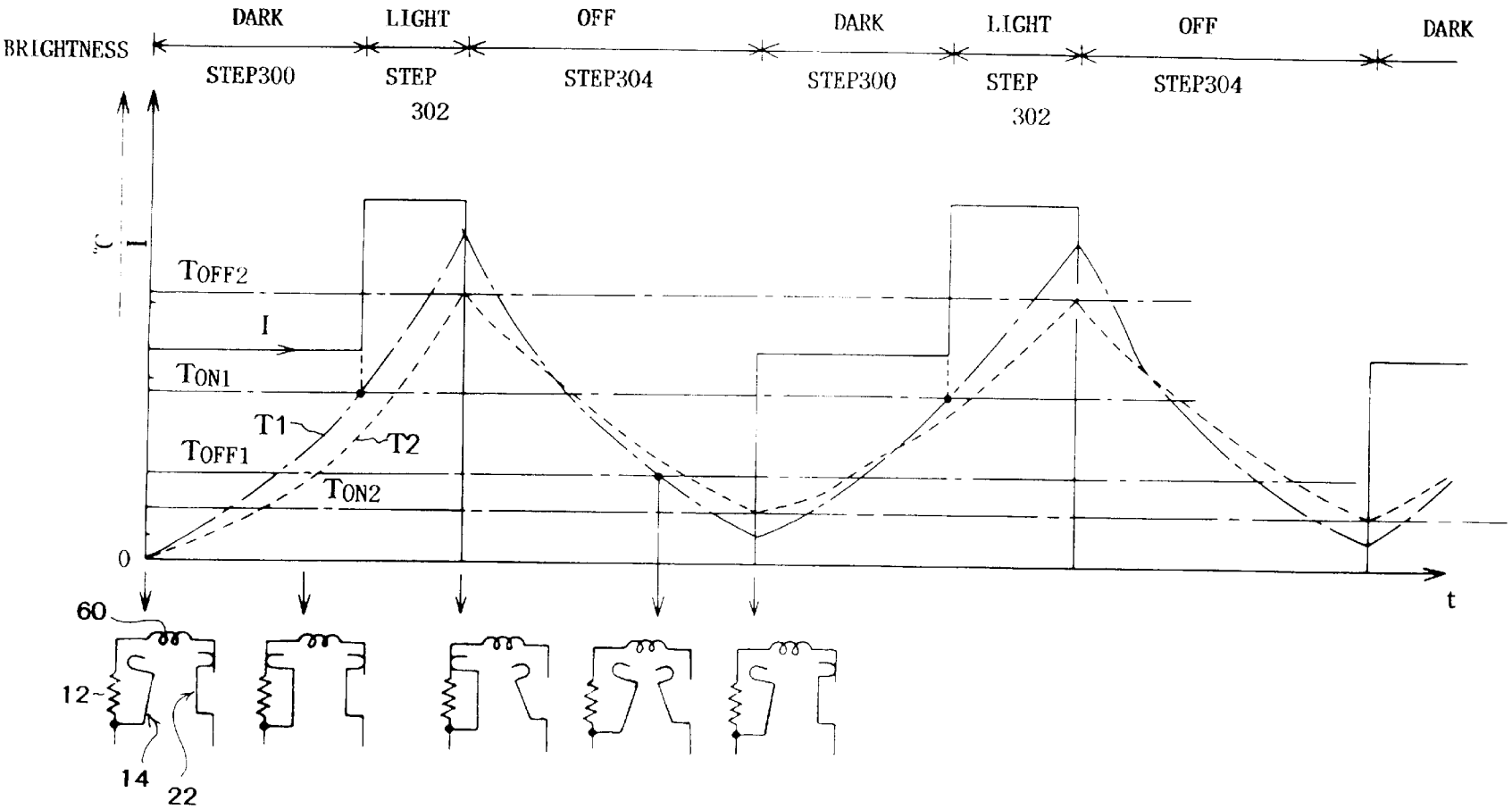
FIG. 6 is a graph showing a relationship between the temperature of a bimetal element and an electric current passing through a filament in the electric-light bulb shown in FIG. 5.

Successively, the action of the electric-light bulb 24 of the present embodiment will be explained with reference to FIGS. 5 and 6.

At the beginning, no electric current is supplied to the electric-light bulb 24, so the temperature of the bulb body 54 is the room temperature. And, temperature T1 of the first bimetal element 14*a* and temperature T2 of the second bimetal element 22*a* are the room temperature. Therefore, the first bimetal element 14*a* opens the first contact points 14*b* of the first thermoswitch 14, so that the resistance 12 is not shorted by the first thermoswitch 14. The second bimetal element 22*a* closes the second contact points 22*b* of the second thermoswitch 22, so that the electric current can be supplied to the filament 60.

When the electric current is supplied to the electric-light bulb 24, the electric current passes through the filament 60 via the resistance 12, so that the electric-light bulb 24 emits light with low brightness (STEP 300).

After a while, the temperature of the bulb body 54 and the bimetal elements 14*a* and 22*a* are raised. As described above, the first thermoswitch 14, whose bimetal element 14*a* has higher thermosensitivity, firstly reaches On-temperature $T_{ON1}$, so that the first contact points 14*b* are closed. Then, the resistance 12 is shorted, and the electric current passing through the filament 60 is not limited, so that the electric-light bulb 24 emits light with higher brightness (STEP 302).

The second thermoswitch 22 reaches Off-temperature $T_{OFF2}$ after the first contact points 14*b* of the first thermoswitch 14 are closed, so that the second contact points 22*b* of the second thermoswitch 22 are opened. Then, the electric current is not supplied to the filament 60, and the electric-light bulb 24 is turned off (STEP 304).

After the electric-light bulb 24 is turned off, the temperature of the bulb body 54 and the bimetal elements 14*a* and 22*a* go down. Since the temperature of the bimetal elements 14*a* and 22*a* goes down, the bimetal elements 14*a* and 22*a* return to the initial states. But the temperature of the first bimetal element 14*a* reaches Off-temperature $T_{OFF1}$ and the first bimetal element 14*a* firstly returns to the initial state, so that the first contact points 14*b* are reopened. By opening the first contact points 14*b*, the resistance 12 is not shorted. In this state, the second contact points 22*b* are still opened, so no electric current is supplied to the filament 60 and the electric-light bulb 24 is still turned-off.

The temperature of the bulb body 54 and the second bimetal element 22*a* go down for a while. When the temperature of the second bimetal element 22*a* reaches On-temperature $T_{ON2}$ and the second bimetal element 22*a* returns to the initial state, so that the second contact points 22*b* are reclosed. Namely, the state returns to the state of STEP 300. In this state, the electric current is supplied to the filament 60 and the electric-light bulb 20 emits light with the low brightness.

As far as the electric current is supplied to the electric-light bulb 24 from outside, the STEPS 300–304 are repeated, so that intensity of the electric current passing through the filament can be periodically changed. Namely, the electric-light bulb 24 can periodically repeat the dark state, the light state, and the turn-off state in order.

In the above-described embodiments, a part or a whole of the lead line 56*b*, for example, may be used as the resistance 12 so as to simplify the structure of the electric-light bulb. Usually, a resistance value of the lead line 56*b* is lower than that of the filament 60, which emits light, so as to effectively consume electric power at the filament 60. In the case that the lead line 56*b* constitutes the resistance 12, when the lead line 56*b* (the resistance) is connected to the filament 60 in series, the brightness of the filament 60 is lower than that of the filament 60 to which the resistance is not connected. The resistance value of the lead line 56*b* is selected to much reduce the brightness. For example, resistance of the lead line 56*b*, with respect to the resistance value "R" of the red-heated filament 60, is 0.5R–2.0R.

The second thermoswitch 22, which is connected to the filament 60 in series, may be attached to, for example, the other lead line 56*a*. Further, the second thermoswitch 22 may be fixed to or accommodated in the pitch 58, which supports the lead lines 56*a* and 56*b*.

In the above described embodiments, the resistance 12 is not a light emitting body and separated from the filament 60, which is a light emitting body. The filament 60 has a resistance value, so a part of the filament 60 may be used as the resistance 12. An example is shown in FIG. 8.

Figure 8:
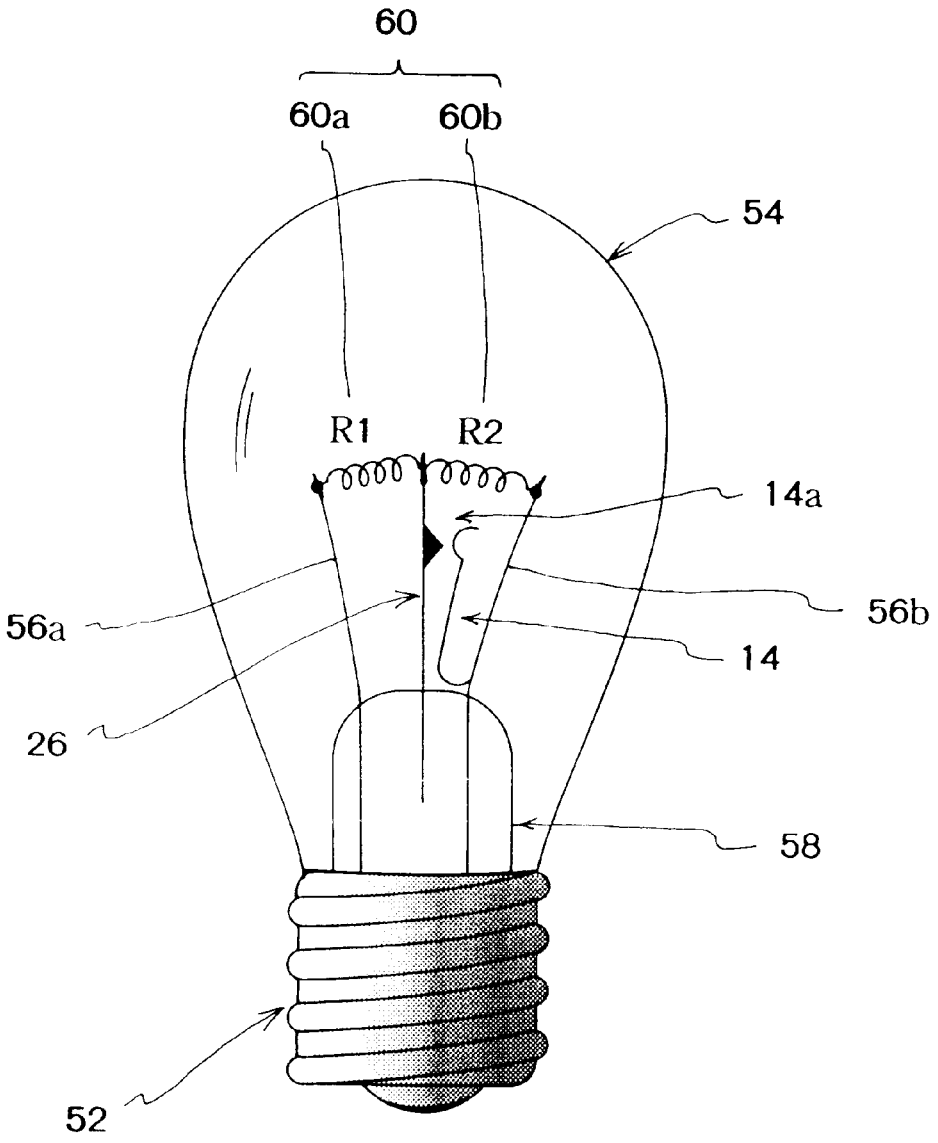
FIG. 8 is an explanation view of another example of a resistance.

In FIG. 8, a support member 26, which supports a center part of the filament 60, is used as an intermediate terminal. A left sub-filament 60*a*, whose resistance value is R1, is used as a normal filament; a right sub-filament 60*b*, whose resistance value is R2, is used as the resistance 12.

The first thermoswitch 14 is connected to the right sub-filament 60*b* in parallel.

The action of the example shown in FIG. 8 is the same as the first embodiment, so explanation will be omitted.

In the example shown in FIG. 8, no resistance body is provided in the bulb body 54, so manufacturing cost can be reduced. The resistance values of the sub-filaments 60*a* and 60*b* can be changed by changing the position of the support member 26. Therefore, the brightness of the filament 60 can be changed by changing the resistance values of the sub-filaments 60*a* and 60*b*.

In the electric-light bulb shown in FIG. 8, the part of the filament 60 can be used as the resistance for limiting the inrush current. The bimetal element 14*a* can be actuated by the heat from the sub-filament 60*a*. The sub-filament 60*b* also radiates heat and light, so that the resistance value of the sub-filament 60*a* can be made low in a short time. And, the brightness of the sub-filament 60*a* can be supplemented by the light from the sub-filament 60*b*. When the sub-filament 60*b* limits the inrush current, the brightness is temporally made higher.

The electric-light bulb shown in FIG. 8 is capable of changing the brightness according to change of pupils of men, which change with time.

The electric-light bulb of the second embodiment may have the support member 26, which is capable of adjusting the supporting position.

By adjusting the intensity of the electric current passing through the filament, the temperature of the filament can be changed. Some filament materials cause a periodical change of the temperature with a change of the current intensity. If a thermocolor-paint, whose color changes with change of temperature, is painted on an inner or outer face of the bulb body 54 or mixed in the glass of the bulb body 54, the brightness and the color of the electric-light bulb can be changed.

A thermochange-gas, whose color changes with change of temperature, may be filled in the bulb body 54. In this case too, the brightness and the color of the electric-light bulb can be changed.

The resistance 12 may be a Nichrome wire (trademark), a manganese wire, the filament, etc.

The contact points of the thermoswitches are apt to be deteriorated by sparks, which are caused when the bimetal elements open and close the contact points. To restrict the deterioration of the contact points, an inert gas, e.g., nitrogen gas, or a mixed gas including the inert gas may be filled in the bulb body. Further, the contact points may be protected by coating with platinum alloy or gold.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An electric-light bulb, comprising:

a bulb body;

a filament being provided in said bulb body;

a resistance being provided in said bulb body, said resistance being connected to said filament in series;

a first thermoswitch being provided in said bulb body, said first thermoswitch being connected to said resistance in parallel, said first thermoswitch including a first bimetal element and first contact points; and a second thermoswitch being provided in said bulb body, said second thermoswitch being connected to said resistance in series, said second thermoswitch including a second bimetal element and second contact points, wherein said first bimetal element and said second bimetal element are deformed by heat radiated from said filament, so that said first contact points are firstly opened so as to reduce an electric current passing through said filament by said resistance, then said second contact points are opened so as to stop the electric current passing through said filament, and wherein said first bimetal element and said second bimetal element return to initial states, so that said first contact points are firstly reclosed, then said second contact points are reclosed.

2. An electric-light bulb, comprising:

a bulb body;

a filament being provided in said bulb body;

a resistance being provided in said bulb body, said resistance being connected to said filament in series;

a first thermoswitch being provided in said bulb body, said first thermoswitch being connected to said resistance in parallel, said first thermoswitch including a first bimetal element and first contact points; and a second thermoswitch being provided in said bulb body, said second thermoswitch being connected to said resistance in series, said second thermoswitch including a second bimetal element and second contact points, wherein said first bimetal element and said second bimetal element are deformed by heat radiated from said filament, so that said first contact points are firstly closed so as to short said resistance and increase an electric current passing through said filament, then said second contact points are opened so as to stop the electric current passing through said filament, and wherein said first bimetal element and said second bimetal element return to initial states, so that said first contact points are firstly reopened, then said second contact points are reclosed.

* * * * *